US005381773A

United States Patent [19]

Straub

[11] Patent Number: 5,381,773

[45] Date of Patent: Jan. 17, 1995

[54] MODULAR IGNITION SYSTEM

[75] Inventor: Stephen W. Straub, Easley, S.C.

[73] Assignee: Cooper Industries, Inc., Houston, Tex.

[21] Appl. No.: 31,009

[22] Filed: Mar. 12, 1993

[51] Int. Cl.[6] ..... F02P 3/12

[52] U.S. Cl. ..... 123/603; 123/169 PA; 123/647

[58] Field of Search ..... 123/169 PA, 169 PB, 123/643, 647

[56] References Cited

U.S. PATENT DOCUMENTS 4,706,639 11/1987 Boyer et al. ..... 123/169 PA X 5,014,656 5/1991 Leptich et al. ..... 123/169 PA X

FOREIGN PATENT DOCUMENTS 230965 9/1990 Japan ..... 123/630

*Primary Examiner*—Raymond A. Nelli

*Attorney, Agent, or Firm*—William B. Patterson; Eddie E. Scott

[57] ABSTRACT

A modular system for providing electrical power to the input contact of an engine igniter is constructed within a hollow container. The container includes a space for mechanically mounting and providing electrical power to the igniter. When the igniter is placed within the hollow container, electrical contact is made between the exciter module and the engine igniter.

11 Claims, 3 Drawing Sheets

FIG. 5
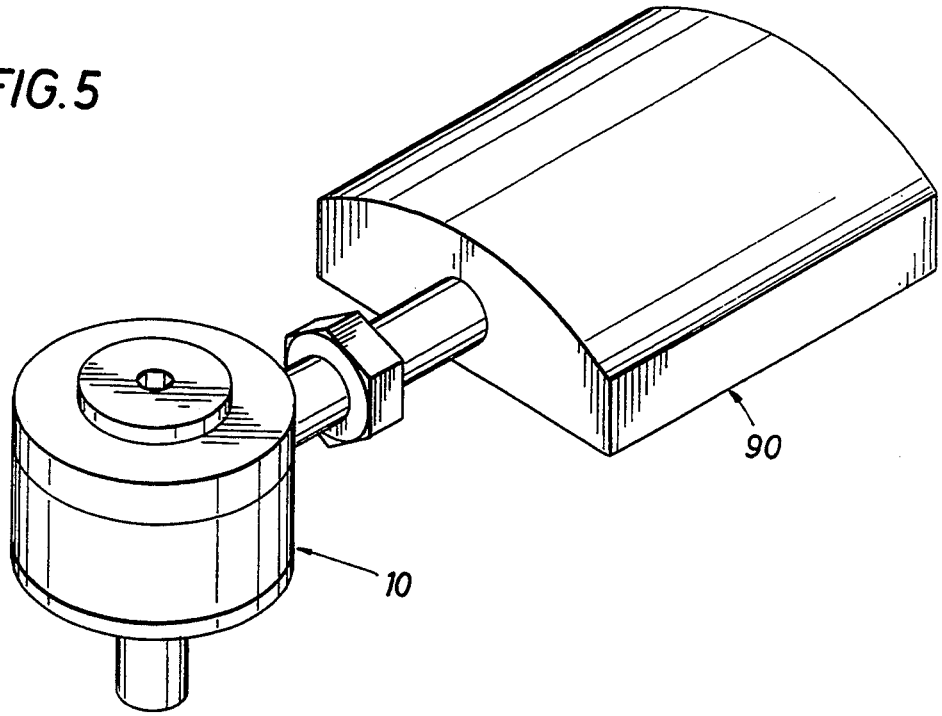
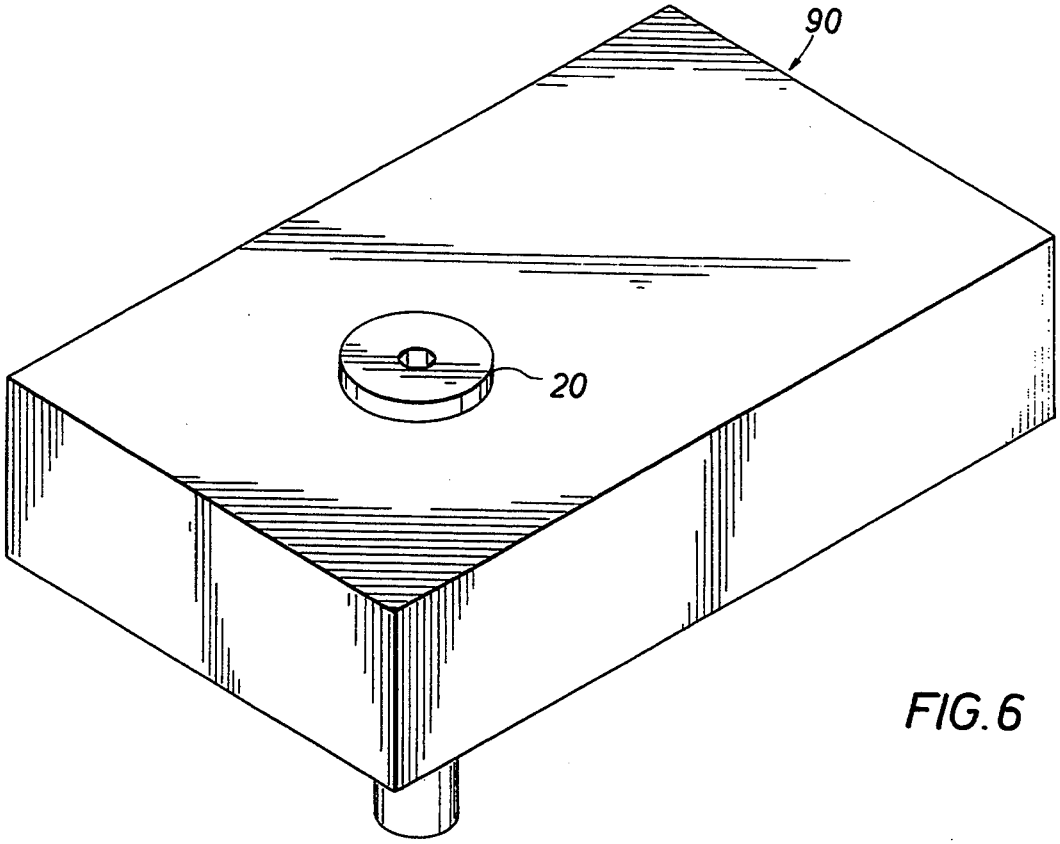
FIG. 6

MODULAR IGNITION SYSTEM

BACKGROUND OF THE INVENTION

The present invention pertains to ignition systems for engines, more particularly, the present invention pertains to a modular ignition system for providing a direct connection between an exciter module and an engine igniter. Prior art ignition systems using igniters utilize fixtures including an electrical lead or wire interface between an exciter module and the igniter. The disadvantage of a system utilizing a lead is that the electrical losses of the leads can detract from the energy output at the engine igniter. This could result in a significant loss of delivered energy. Additionally, the exciter is located at a distance away from the igniter. This remote placement of the exciter requires the use of an ignition lead, additional mounting hardware, and more importantly, adds additional weight to the ignition system and the engine. The ignition lead requires multiple electrical connections and introduces increased energy loss, increased electrical interference, and increased ignition system cost.

Because of the energy losses between the exciter module and the engine igniter, it is often necessary to utilize a higher output exciter module than called for to make up for the energy loss. Additionally, repair and replacement of engine ignition system components is complicated by the fact that these components are located at various locations. Current ignition systems require that the igniter first be attached to the engine (typical means are a screw thread or flange mounted configuration) and then the electrical lead is attached to the igniter. The present invention eliminates the need to make a separate lead connection to the igniter. This is a significant improvement over existing technology since some engine applications have very limited space which inhibits lead to igniter connections. Frequently, current technology designs require two tools to remove the lead from the igniter (one tool holds the igniter from unscrewing from the engine while the other tool unscrews the lead nut from the igniter). The present invention utilizes one tool for installation and removal of the igniter. The igniter can be designed to accept virtually any suitable wrenching configuration as hex, torx, or slotted body for removing and installing the igniter.

There is, therefore, a need to provide a system which reduces energy losses through leads, eliminates the need for additional mounting hardware, and reduces the weight of the ignition system.

SUMMARY OF THE INVENTION

A modular system for providing electrical power to the input contact of an engine igniter is constructed within a hollow container or ignition adapter. The ignition adapter includes a space for mechanically mounting and providing electrical power to the igniter module. When the igniter is placed within the ignition adapter, electrical contact is made between the exciter module and the engine igniter. Accordingly, the exciter may be connected directly to the igniter without the use of an ignition lead.

An object of the present invention is to provide a modular ignition system which eliminates the need for additional igniter mounting hardware and special tools for making electrical connections. Igniter construction is thereby simplified, resulting in lower component costs and lower assembly cost.

A further object of the present invention is to provide easy replacement of portions of the igniter when required without replacing the entire igniter.

A still further object of the present invention is to provide a modular design which permits easy tailoring of the igniter to exact customer needs and facilitates changes to alternate igniter configurations.

An object of the present invention is to provide an igniter with a shorter installed height when compared to prior igniters.

A further object of the present invention is to provide a means of providing electrical power to the igniter without the use of an ignition lead to connect to the exciter module.

DESCRIPTION OF THE DRAWINGS

A better understanding of the modular ignition system of the present invention may be had by reference to the figures wherein:

FIG. 5 is an isometric view of the igniter installed in the ignition adapter assembly and attached directly to an exciter module without the use of an ignition lead.

FIG. 6 is an isometric view of the igniter installed in the ignition adapter assembly which also contains the exciter module.

DESCRIPTION OF THE PREFERRED EMBODIMENT

Figure 1:
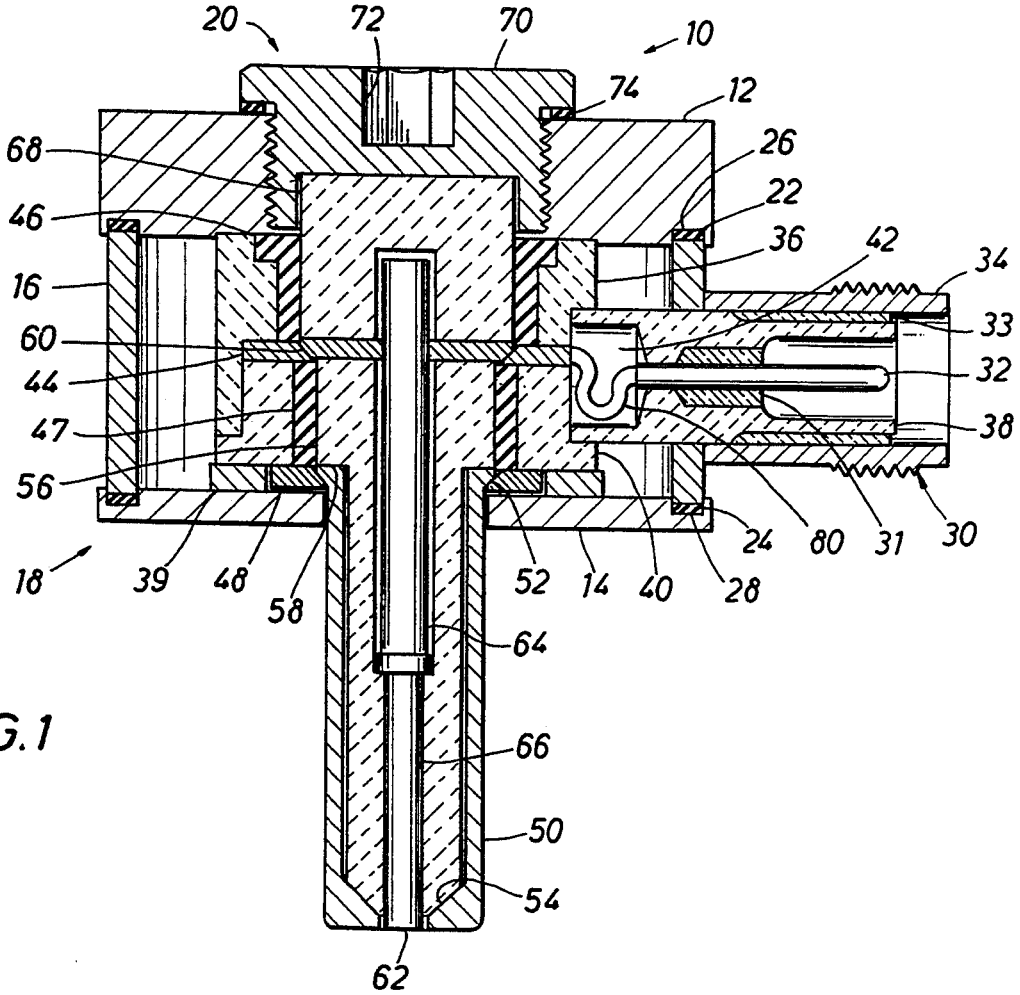
FIG. 1 is an elevation view in section of the modular ignition system of the present invention showing the spatial relationship of the various internal parts.
Figure 2:
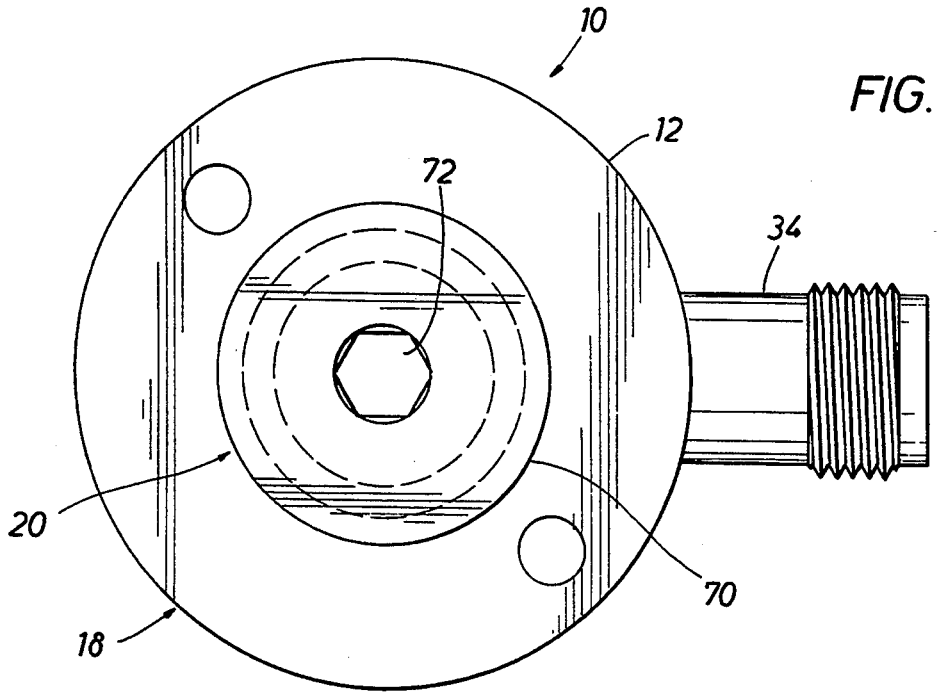
FIG. 2 is a top view of the modular ignition system.

A better understanding of the modular ignition system 10 of the present invention may be had by reference to FIGS. 1 and 2. The modular ignition system 10 includes adapter upper plate 12 and adapter lower plate 14 maintained in a spaced apart relationship by cylindrical adapter tube 16 to define an ignition adapter assembly 18 sized to receive an engine igniter assembly 20. Such engine igniters are typically used in aircraft engines or other types of engines where an exciter module and lead (not shown) are required to provide the proper voltage to the engine igniter assembly 20 to cause arcing across the firing end electrodes of the engine igniter assembly 20. Further description of the construction of the engine igniter assembly 20 will follow a description of those portions within the interior of the ignition adapter assembly 18.

Figure 3:
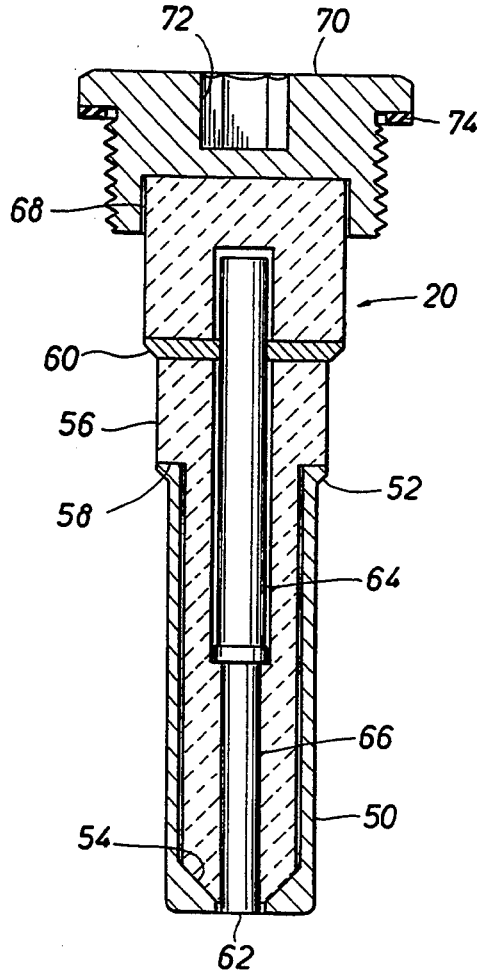
FIG. 3 is an elevation view, in section, of the igniter.

With specific reference to FIGS. 1 and 3, it may be seen that the ignition adapter assembly 18 is constructed and arranged to contain the engine igniter assembly 20. Annular grooves 22 and 24 in adapter upper plate 12 and adapter lower plate 14, respectively, receive sealing gaskets 26 and 28. Adapter upper plate 12 is threaded and adapter lower plate 14 is drilled to receive bolts (not shown) which will cause a clamping force between upper plate 12 and lower plate 14, which will create a load on sealing gaskets 26 and 28, and contain all internal components of the adapter assembly 18.

Connector subassembly 30 is disposed radially in the wall of adapter tube 16 with high tension contact 32 and threaded connector bushing 34 extending therefrom.

The connector subassembly 30 is joined to the adapter tube 16 using a suitable means such as brazing or welding. An airtight seal is formed between threaded connector bushing 34 and connector ceramic sleeve 38 by using a suitable sealing means 33 such as a glass seal, powder seal or braze joint. An airtight seal is also formed between high tension contact 32 and connector ceramic sleeve 38 by using a suitable sealing means 31 such as a glass seal, powder seal or braze joint. Seals 31 and 33 prevent pressurized engine gases from escaping through the ignition adapter assembly 18.

High tension contact 32 and threaded connector bushing 34 provide electrical power to engine igniter assembly 20 in a manner to be described hereinafter. Adapter upper ceramic ring 36, connector ceramic sleeve 38 and adapter lower ceramic ring 40 are arranged as shown within adapter tube 16 to form an insulating sleeve about engine igniter assembly 20. An opening or aperture 42 is formed in the end of connector ceramic sleeve 38 to allow high tension contact 32 to connect to engine igniter assembly 20.

Adapter electrical contact ring 44 is a split ring which is radially disposed between adapter upper ceramic ring 36 and adapter lower ceramic ring 40. High tension contact 32 is connected to adapter electrical contact ring 44 by means of electrical wire 80. Electrical wire 80 is connected to high tension contact 32 and adapter electrical contact ring 44 by suitable means as soldering or welding. The inner surface of adapter electrical contact ring 44 is bevelled and in combination with the split in adapter electrical contact ring 44 ensures a tight fit and positive electrical connection between adapter electrical contact ring 44 and igniter electrical contact 60 in igniter assembly 20. Adapter upper seal 46 is positioned between adapter upper ceramic ring 36 and engine igniter assembly 20 while adapter lower seal 47 is positioned between adapter lower ceramic ring 40 and engine igniter assembly 20 to ensure adequate electrical insulation between adapter electrical contact ring 44 and adapter ground contact ring 48.

Adapter ground contact ring 48 is a split ring positioned below adapter lower ceramic ring 40 and above adapter lower plate 14. Spacer disk 39 allows free movement of adapter ground contact ring 48 by providing adequate clearance between adapter lower ceramic ring 40 and adapter lower plate 14. Threaded connector bushing 34 is connected electrically to adapter ground contact ring 48 by contact through adapter tube 16 and adapter lower plate 14. The inner surface of adapter ground contact ring 48 is bevelled and in combination with the split in adapter ground contact ring 48 ensures a tight fit and positive electrical connection between adapter ground contact ring 48 and igniter shell upper lip 52 of engine igniter assembly 20.

As best seen in FIGS. 1 and 3, engine igniter assembly 20 includes igniter lower shell 50 with igniter shell upper lip 52 contacting adapter ground contact ring 48 to provide electrical power to the ground side of igniter assembly 20. Igniter lower shell 50 has a radially inwardly turned lower lip 54 upon which igniter lower insulator 56 rests. Igniter lower insulator 56 is constructed of a ceramic insulating material with an upper shoulder 58 sitting on igniter shell upper lip 52 of igniter lower shell 50. Igniter electrical contact 60 is positioned above igniter lower insulator 56 with a bevelled outer shoulder to contact a mating shoulder on adapter electrical contact ring 44 to which high tension contact 32 is connected. Center electrode 62 is of two part construction with upper electrode 64 and lower electrode 66. Lower electrode 66 has an enlarged upper end which rests on an internal shoulder formed on the interior of igniter lower insulator 56. Upper electrode 64 is sized to be an interference fit or braze or weld joint with igniter electrical contact 60 to ensure positive electrical contact. Upper insulator cap 68 is constructed of a suitable insulating material such as ceramic and is sized to fit over upper electrode 64 and inside adapter upper seal 46. Igniter assembly 20 is surmounted by cap 70 which is threaded to engage a complementary thread on adapter upper plate 12 and secure igniter assembly 20 within ignition adapter assembly 18. Suitable wrenching means such as internal hex 72 is positioned on the top face of cap 70 to allow easy tightening of cap 70 within adapter upper plate 12. Optionally, a slot, torx or other similar wrenching means such as an external hex may be used. Sealing gasket 74 is disposed between cap 70 and adapter upper plate 12 and is activated when cap 70 is fully tightened to prevent engine pressure from escaping out of the adapter.

OPERATION

Figure 4:
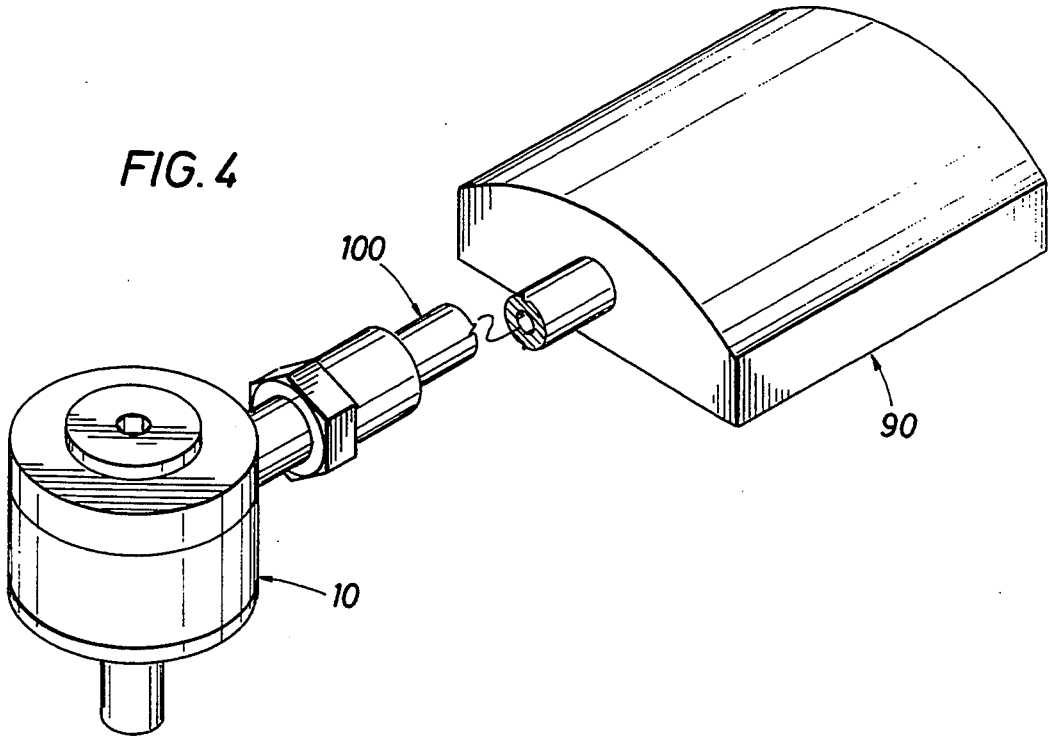
FIG. 4 is an isometric view of the igniter installed in the ignition adapter assembly and attached by an ignition lead to an exciter module.

Modular ignition system 10 is attached to the engine by adapter lower plate 14 with connector subassembly 30 attached to ignition lead 100 and exciter module 90 as seen in FIG. 4. When electrical power is supplied to exciter module 90, a high voltage signal is transferred through ignition lead 100 to high tension contact 32 which is attached to adapter electrical contact ring 44 by means of electrical wire 80. The high voltage signal is then transferred to igniter electrical contact 60 which connects to center electrode 62. Arcing occurs between center electrode 62 and igniter lower shell 50 which is connected to threaded connector bushing 34 through adapter ground contact ring 48 through adapter lower plate 14, through adapter tube 16 to ignite the fuel mixture in the combustion chamber. FIG. 5 shows an alternate construction in which ignition lead 100 is eliminated and exciter module 90 is connected directly to ignition adapter assembly 18 with igniter assembly 20 disposed therein. The high voltage signal of exciter module 90 is transferred directly to high tension contact 32 which is attached to adapter electrical contact ring 44 by means of electrical wire 80. FIG. 6 shows a second alternate construction in which igniter assembly 20 is installed within exciter module 90. This allows the high voltage signal of exciter module 90 to be transferred directly to adapter electrical contact ring 44 by means of electrical wire 80. In all other respects, these alternate constructions function as in the preferred embodiment.

An alternate design would eliminate spacer disk 39 and adapter ground contact ring 48 but add a bevelled surface in adapter lower plate 14. This alternate design option would seal engine gases from entering the ignition adapter assembly 18 by making a seal between adapter lower plate 14 and igniter shell upper lip 52. With this alternate design option, adapter seals 31 and 33 and igniter sealing gasket 74 would not be necessary.

The construction of the modular igniter module ignition system and the methods of its application will be readily understood from the foregoing description and it will be seen I have provided a modular ignition system which eliminates the need for additional igniter mounting hardware and special tools for making electrical connections. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A modular ignition system, comprising:

an engine igniter;

an exciter module;

a hollow container, said hollow container including: means for mechanically mounting said engine igniter; electrical contact means for providing electrical power to said engine igniter;

said hollow container and said exciter module constructed and arranged for the direct mechanical attachment and electrical connection of said exciter module to said engine igniter;

said hollow container constructed and arranged to surround said engine igniter when said hollow container is mounted to an engine.

2. A method of providing electrical power directly from an exciter module to an engine igniter, said method comprising the steps of:

securing a hollow container to an engine;

placing said engine igniter within said container so that electrical contact is made between an exciter module and said engine igniter; and, providing electrical power through said hollow container to said exciter module.

3. The method as described in claim 2 further including the step of protecting said engine igniter by sealably containing said engine igniter within said hollow container.

4. The system as defined in claim 3 further including the step of providing cooling means for said engine igniter.

5. The system as defined in claim 4 further including the step of providing cooling means for said engine exciter module.

6. An adapter for providing power to an engine igniter, said adapter comprising:

an adapter body having means for attachment to an engine;

means within said adapter body for insertion and retention of the igniter; and first and second means for electrical connection of said igniter to a source of electrical power;

whereby, the igniter is electrically disconnected from the source of electrical power when the igniter is removed from the adapter.

7. The adapter as set forth in claim 6, whereby the first means for electrical connection of the igniter to the source of electrical power includes a first conductive point within the adapter body, the point being in electrical contact with a center electrode of the igniter and in electrical contact with the source of electrical power.

8. The adapter as set forth in claim 7, whereby the first conductive point is a first ring, an inside surface of the first ring in contact with the center electrode of the igniter and an outside surface of the first ring in contact with the source of electrical power.

9. The adapter as set forth in claim 6, whereby the second means for electrical connection of the igniter to the source of electrical power includes a second conductive point within the adapter body, the second point being in electrical contact with an outer shell of the igniter and in electrical contact with the source of electrical power.

10. The adapter as set forth in claim 9, whereby the second conductive point is a second ring, an inside surface of the second ring in contact with the outer shell of the igniter and an outside surface of the second ring in contact with the source of electrical power.

11. The adapter as set forth in claim 6, further including means for mechanical connection between the igniter and the source of electrical power, the mechanical connection including a connector assembly, the connector assembly including a substantially cylindrical body constructed and arranged to extend between the adapter and the source of electrical power, thereby providing a mechanical connection between the source of electrical power and the igniter.

* * * * *